US011569026B2

(12) United States Patent
Hofmann et al.

(10) Patent No.: US 11,569,026 B2
(45) Date of Patent: Jan. 31, 2023

(54) COMPACT DRY-TYPE TRANSFORMER

(71) Applicant: Siemens Energy Global GmbH & Co. KG, Munich (DE)

(72) Inventors: Bernd Hofmann, Kirchheim (DE); Benedikt Hönisch, Erlangen (DE); Tim-Felix Mai, Wendlingen (DE); Christian Seidel, Schwaig (DE); Steffen Weinert, Wangen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 1203 days.

(21) Appl. No.: 15/999,519

(22) PCT Filed: Jan. 30, 2017

(86) PCT No.: PCT/EP2017/051934

§ 371 (c)(1),
(2) Date: Aug. 17, 2018

(87) PCT Pub. No.: WO2017/140482

PCT Pub. Date: Aug. 24, 2017

(65) Prior Publication Data

US 2021/0210279 A1 Jul. 8, 2021

(30) Foreign Application Priority Data

Feb. 17, 2016 (DE) ..... 10 2016 202 391.8

(51) Int. Cl.
*H01F 27/32* (2006.01)
*H01F 41/06* (2016.01)
(Continued)

(52) U.S. Cl.
CPC ..... *H01F 27/327* (2013.01); *H01F 27/363* (2020.08); *H01F 41/06* (2013.01); *H01F 41/127* (2013.01)

(58) Field of Classification Search
USPC ..... 336/222, 84, 5
See application file for complete search history.

(56) References Cited

U.S. PATENT DOCUMENTS 3,517,361 A * 6/1970 Reifel ..... H01F 27/363 336/84 R
5,716,553 A 2/1998 Bergmann et al. ..... 252/520.1
(Continued)

FOREIGN PATENT DOCUMENTS

CA 898921 A 4/1972 ..... H01F 27/22
DE 19823867 A1 12/1999 ..... C08K 9/02
(Continued)

OTHER PUBLICATIONS

Russian Office Action, Application No. 2018129877/07, 7 pages, dated May 23, 2019.
(Continued)

*Primary Examiner* — Shawki S Ismail
*Assistant Examiner* — Kazi S Hossain
(74) *Attorney, Agent, or Firm* — Slayden Grubert Beard PLLC

(57) ABSTRACT

The present disclosure relates to transformers. Various embodiments of the teachings herein may include a coating of an insulation body of a dry transformer. For example, the electrical winding may include multiple windings of a winding conductor wound to form a coil. The coil has been embedded into a solid insulation body. In some embodiments, a coating of an electrically conductive material, comprising a resin matrix and microscale filler, has been applied to at least one surface of the insulation body.

16 Claims, 1 Drawing Sheet

(51) Int. Cl.
*H01F 41/12* (2006.01)
*H01F 27/36* (2006.01)

(56) References Cited

U.S. PATENT DOCUMENTS

| | | | | |
|---|---|---|---|---|
| 6,162,374 | A | 12/2000 | Schoen et al. | 252/511 |
| 2014/0361862 | A1* | 12/2014 | Ballard | H01F 27/322<br>242/433 |

FOREIGN PATENT DOCUMENTS

| | | | | |
|---|---|---|---|---|
| EP | 1133779 | B1 | 3/2005 | H01F 27/32 |
| FR | 2784787 | A1 * | 4/2000 | H01F 27/085 |
| FR | 2784787 | A1 | 4/2000 | H01F 27/08 |
| GB | 1145450 | * | 3/1969 | |
| GB | 1145450 | A | 3/1969 | H01B 1/00 |
| GB | 1156369 | A | 6/1969 | H01F 27/32 |
| RU | 2107350 | C1 | 3/1998 | H01F 27/36 |
| SU | 1645026 | A1 | 4/1991 | B05D 1/38 |
| WO | 2008/031015 | A1 | 3/2008 | C09D 11/00 |
| WO | 2017/140482 | A1 | 8/2017 | H01F 27/28 |

OTHER PUBLICATIONS

German Office Action, Application No. 102016202391.8, 10 pages, dated Sep. 20, 2016.
International Search Report and Written Opinion, Application No. PCT/EP2017/051934, 21 pages, dated Apr. 10, 2017.
European Office Action, Application No. 17702601.0, 6 pages, dated Oct. 15, 2020.

* cited by examiner

COMPACT DRY-TYPE TRANSFORMER

CROSS-REFERENCE TO RELATED APPLICATIONS

This application is a U.S. National Stage Application of International Application No. PCT/EP2017/051934 filed Jan. 30, 2017, which designates the United States of America, and claims priority to DE Application No. 10 2016 202 391.8 filed Feb. 17, 2016, the contents of which are hereby incorporated by reference in their entirety.

TECHNICAL FIELD

The present disclosure relates to transformers. Various embodiments of the teachings herein may include a coating of an insulation body of a dry transformer.

BACKGROUND

Dry transformers, e.g., cast resin transformers, are power transformers used in power engineering for transformation of voltages up to about 36 kV on the high-voltage side. In such transformers, a low-voltage winding and a high-voltage winding are arranged coaxially around a limb of a core. The low-voltage winding refers to that winding with the lower voltage, and the high-voltage winding to that with the higher voltage. Both windings may be embedded into a solid insulation material; in the case of the high-voltage winding, a casting resin is frequently used for the purpose. Such a dry transformer is known from EP 1133779 B1.

The as yet unpublished EP 15185886 A1 discloses a further development of the above-described dry transformer, especially also for higher voltages than 36 kV. This discloses a more compact design of the dry transformer, the features of which include smaller dimensions of the dry transformer, i.e. a more compact design, and in this context also replacement of air as insulator by a suitable casting resin as solid insulation body.

On the surface of the solid insulation body into which an electrical winding, i.e. more particularly a high- and/or low-voltage winding wound to a coil, has been embedded, a coating may be composed of a semiconductor material. Particular demands are made on the chemical and/or physical properties of this semiconductive coating, especially with regard to thermal, mechanical and chemical stability, as well as a defined sheet resistance. There is therefore a need to provide a suitable coating of the insulation body of a dry transformer that fulfills such a profile of properties.

SUMMARY

The teachings of the present disclosure may be embodied in an electrical winding for a dry transformer with a compact design and/or a process for producing a coating for an insulation body of such an electrical winding of a dry transformer in compact design. In some embodiments, the coating is provided at least on a surface of the insulation body having a sheet resistance in the range from $10^2$ to $10^5$ ohms/square and exhibiting high thermal stability, high mechanical robustness and resistance to environmental effects such as moisture and insolation. For example, some embodiments may include an electrical winding, especially a high-voltage winding, for a dry transformer with a winding conductor wound in multiple windings to form a coil, said coil having been embedded in a solid insulation body, characterized in that a coating having a particular sheet resistance has been provided on at least one surface of the insulation body, the coating is producible by application of a formulation and comprises a resin component and at least one microscale and electrically conductive filler, where filler is present in a particle size in the range from 1 μm to 2 mm.

In some embodiments, filler is present in the coating in an amount of more than 20% by weight and/or more than 10% by volume.

In some embodiments, the coating completely covers the surface of the insulation body.

In some embodiments, the coating is composed of semiconductive material.

In some embodiments, the coating has at least bimodal filling, i.e. at least two filler particle fractions are present in the coating.

In some embodiments, the surface resistance of the coating is $10^2\Omega/\square$ to $10^5\Omega/\square$, or $10^3\Omega/\square$ to $10^4\Omega/\square$.

In some embodiments, the formulation is applicable by a spraying method for production of the coating.

In some embodiments, the formulation comprises water as solvent.

In some embodiments, the coating has been grounded.

In some embodiments, the defined sheet resistance of the coating is adjustable via the setting of the ratio of at least two filler particle fractions in the formulation.

In some embodiments, the defined sheet resistance of the coating is adjustable via the setting of the ratio of coated to uncoated filler particles in the formulation.

Some embodiments may include a process for producing an electrical winding, comprising: winding a winding conductor in multiple windings to form a coil, embedding the coil into a solid insulation body, preferably by potting with a casting resin and subsequent curing of the insulation body, setting a particular ratio of at least two filler particle fractions composed of microscale fillers in a formulation for production of a coating of a predetermined sheet resistance, and applying the formulation for production of the coating to at least one surface of the insulation body.

In some embodiments, the coating is applied to the entire surface of the insulation body.

In some embodiments, the coating is composed of a semiconductive material.

In some embodiments, the coating is produced by spray application of a formulation and subsequent curing.

In some embodiments, the formulation is applied by painting, spraying, coating, rolling and/or in the form of a dip-coating.

In some embodiments, the formulation is applied as a water-based solution.

BRIEF DESCRIPTION OF THE DRAWINGS

The teachings herein are elucidated in detail hereinafter with reference to a FIGURE.

DETAILED DESCRIPTION

Figure 1:
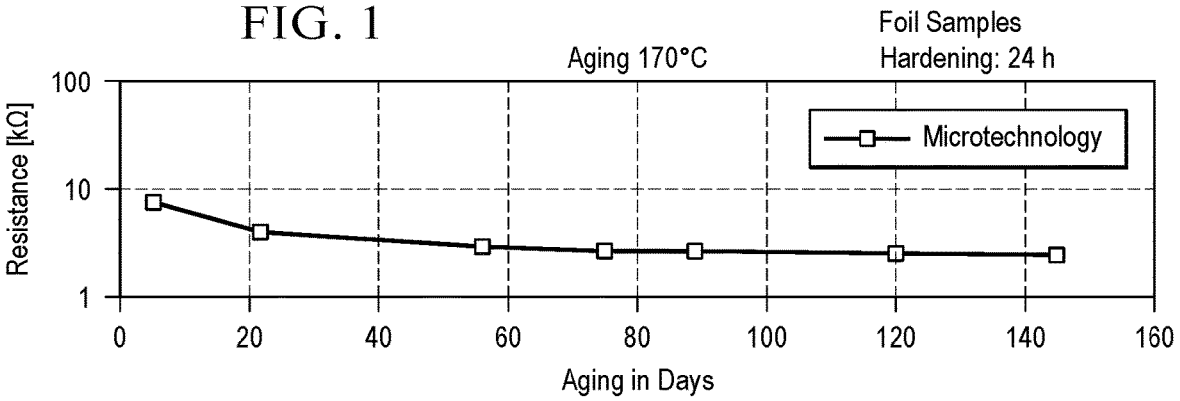
FIG. 1 is a graph showing the aging of a semiconductor coating within 150 days at 170° C. After solidification of the coating within the first few days, stable retention of the defined sheet resistance in spite of the storage at 170° C. is apparent over the entire period under consideration that amounts to half a year.

In some embodiments, there is an electrical winding, especially a high-voltage winding, for a dry transformer with a winding conductor wound in multiple windings to form a coil, said coil having been embedded in a solid insulation body, wherein at least one surface of the insulation body has a coating having a particular sheet resistance, which comprises a resin component and at least one microscale and electrically conductive filler, wherein electrically conductive filler is present in a particle size in the range from 1 μm to 2 mm.

In some embodiments, the winding conductor may be a film conductor, a tape conductor or a wire conductor. The coil has been embedded into an insulation body composed of a solid insulation material. In some embodiments, a casting resin is used for this purpose, with which the coil is potted and which is cured after the potting. As a result, a mechanically stable winding is obtained in the form of a hollow cylinder, the coil of which has good protection from environmental influences. In some embodiments, a coating composed of a resin mixture having a microscale and electrically conductive filler has been applied to at least one surface of the insulation body.

In some embodiments, a process for producing an electrical winding, may include:

- winding a winding conductor in multiple windings to form a coil,
- embedding the coil into a solid insulation body, preferably by potting with a casting resin and subsequent curing of the insulation body,
- setting a predetermined sheet resistance in a formulation for production of a coating by incorporating at least one microscale filler fraction of electrically conductive filler particles into an unhardened resin, and
- applying the formulation for production of the coating to at least one surface of the insulation body.

In some embodiments, the filler includes at least one microscale filler fraction, the filler content of which accounts for more than 20% by weight and/or more than 10% by volume of the coating.

In some embodiments, there are at least two filler particle fractions in the coating. In some embodiments, the at least two filler fractions include microscale filler particles. In some embodiments, a defined sheet resistance is determinable via the ratio in which at least two filler fractions are present in the coating.

In some embodiments, the coating is applied in a formulation. This involves applying a processible, e.g., free-flowing, mixture of an uncured resin component with a hardener, either in the form of two separate components or present in one component, to a surface with added filler and in solution. Subsequently, this formulation is cured on the surface, for example by thermal and/or UV-initiated reaction, to give the finished coating.

In some embodiments, the resin matrix comprises a 2-component system composed of resin and hardener. A water-soluble 2-component system avoids organic solvents in the production of the coating, which are generally regarded as hazardous to the environment. It is possible here to process hardener component and/or resin component in aqueous solution.

In some embodiments, a one- or two-component resin system which is environmentally compatible, especially through the use of water-based solvents, is used. For example, through the use of an aqueous polyurethane acrylate resin system, it is possible to realize far-reaching ecological aspects such as dispensing with recycling or postcombustion of the solvent. At the same time, another factor is facilitation of occupational protection for the operator and/or manufacturer, for example a painting operative. Therefore, water-based solvents are sufficient.

Among experts and in the context of the disclosure, a material is considered to be electrically conductive when the electrical resistance is less than $10^8\Omega/\square$. Above that, a material is considered to be an insulator or nonconductive. In some embodiments, the coating covers at least the inner shell face of the insulation body, and/or the end faces. In some embodiments, the coating has been applied over the entire surface of the insulation body, i.e. not only on the inner shell face and the end faces but also on the outer shell face. Such a coating substantially degrades the electrical field of the electrical winding within the casting resin and thus reduces it outside the winding to a size that allows the separation from other constituents of the transformer, such as core or low-voltage winding, to be reduced, which enables a more compact design.

In some embodiments, the coating comprises a semiconductor material. A semiconductor material is considered among experts and in the context of the disclosure to be one having a specific resistance of less than $10^8\Omega/\square$ and greater than $10^1\Omega/\square$. Since an electrically conductive coating, especially one of the entire surface, of a winding constitutes a short-circuit winding, a current that generates a power loss will flow therein. A coating composed of a semiconductor material can limit this power loss.

In some embodiments, conductive or semiconductive coatings are based on a resin system into which a microscale semiconductive filler has been incorporated, e.g., in an amount of more than 20% by weight and/or 10% by volume, in the range from 20% by weight to 80% by weight, between 50% by weight and 60% by weight and/or the corresponding percentages by volume in the case of lightweight, especially hollow, filler particles.

In some embodiments, a two-component resin system having a first component selected from the group of the following resins: epoxy resin, polyurethane resin, acrylate resin, polyimide resin and/or polyester resin system, and any desired mixtures, copolymers and blends of the aforementioned resins is suitable for the purpose. The second component added to the formulation is, for example, a hardener matched to the particular resin, such as amine, acid anhydride, peroxide, polyisocyanate, especially aliphatic polyisocyanate. A water-soluble hardener component provides environmental compatibility, because this dispenses with the postcombustion of the solvent and, in general terms, the use of organic solvents is ecologically disadvantageous for the purposes of sustainability.

The formulation has a certain processing time in which it is applied as an uncrosslinked formulation for coating to at least one surface of the insulation body. The application is effected, for example, by spraying, painting, rolling and/or by dipping. After curing, the formulation crosslinks and attains stability to environmental influences, insolation, mechanical stresses etc. The crosslinking is supported, for example, by heating.

In some embodiments, the coating has stability at temperatures up to 170° C.

In some embodiments, to attain a defined electrical conductivity, at least two fractions of a microscale filler are added to the formulation. This microscale filler is present in the dry mass of the formulation and/or in the coating in an amount of more than 20% by weight and/or 10% by volume; it may even be present in an amount of up to 80% by weight of the dry mass, in the range from 35% by weight to 75% by weight, from 40% by weight to 60% by weight, of the dry mass of the formulation and/or the corresponding percentage by volume in the case of lightweight filler particles.

In some embodiments, a suitable filler includes a microscale filler having a median grain size $D_{50}$ in the range from about 1 μm to 2 mm, for example in the range from 5 μm to 100 μm, or in the range from 10 μm to 50 μm. The filler may comprise all kinds of filler particle forms. For example, it is possible for globular fillers to be present mixed with fillers in platelet form. In the case of very lightweight filler particles present in combination or alone in the formulation, the limit of at least 20% by weight is replaced by the corresponding percentage by volume; in other words, for example, about 10% by volume is assumed to be the lower limit.

In some embodiments, the filler particles comprise semiconductive material. For example, the material may be conductive black, conductive graphite, graphite, metal oxide and/or metal nitrides, and any mixtures thereof. The filler particles may equally comprise a core with a shell or a core with a coating. The filler particles may also be hollow; in particular, hollow fibers and/or hollow spheres are also usable alone or in combination with other filler particle fractions.

In some embodiments, the filler used comprises a core of mica, for example, coated with semiconductive material. A filler comprising a quartz flour with a coating and any desired mixtures of coated and uncoated filler particles may be used here as filler.

Semiconductive coatings used may include metals, metal oxides, and/or doped metal oxides. Semiconductive hollow spheres, hollow fibers and/or shells may also be used as filler particles. The lower limit for these very lightweight filler particles is then a filler level of about 10 percent by volume in the coating. The fillers may be multimodal, i.e. may be used in various filler particle sizes and/or filler particle forms.

By virtue of a suitable selection of material for the filler particles, filler particle size, filler particle form, filler particle structure, grain size distribution, size of the specific surface area and/or surface activity of the filler, it is possible to produce a widely diversified profile of properties in the coating. In some embodiments, the coating has a specific area resistance, also called sheet resistance, of $10^2\Omega/\square$ to $10^5\Omega/\square$, preferably $10^3\Omega/\square$ to $10^4\Omega/\square$. This area resistance is possessed by the electrical winding in the new state. This can change as a result of aging, environmental effects or soiling. An area resistance of this order of magnitude on the one hand limits the power loss in a particularly effective manner, but on the other hand still gives enough latitude in the event of reduction of the area resistance by soiling.

In some embodiments, the thickness of the coating is at least in the region of the filler particle size, for example in the range from 1 μm to 5 mm, in the range from 30 μm to 500 μm, or in the range from 70 μm to 130 μm. For example, a mixture of a filler fraction comprising coated filler particles, such as semiconductive metal oxide-coated mica particles, and a filler fraction comprising a semiconductor material such as a conductive black may be used in the formulation for the coating. The two filler fractions may be present in the mixture, for example, in a ratio of 1:1, or it is possible for different amounts to be present, in which case ratios of coated filler particles to uncoated filler particles in the range from 0.5 to 2.5, from 0.7 to 1.5 or from 0.8 to 1.2 are in use.

In some embodiments, the coating has been applied by brush application and/or a spraying method. Especially application by spraying firstly ensures a homogeneous layer thickness and secondly prevents inclusions of air that would lead to partial discharges.

In some embodiments, the coating is electrically grounded. This particularly effectively reduces the electrical field outside the winding.

The coating may be applied to the entire surface or only to parts of the surface of the insulation body, as already described. The insulation body may comprise an epoxy resin, for example, with a particular surface roughness of the insulation body on the sides to be coated for the adhesion of the coating on the surface.

In some embodiments, to achieve a homogeneous distribution of the filler particles, a dispersing additive, for example a surfactant and/or an ionic-based additive may be added to the formulation. By such a process, it is possible to produce an electrical winding, the electrical field of which is largely shielded by the coating, and which, used in a dry transformer, thus enables a more compact design. The coating may comprise a paint. The coating can be applied here by spraying, painting, rolling and/or in the form of a dip-coating. It is possible here for two or more of the processes mentioned to be used successively or simultaneously for application of the formulation.

In some embodiments, the surface of the insulation body is treated prior to the application of the formulation, so as to ensure good adhesion of the formulation and subsequently of the coating on the insulation body.

The coating may comprise a semiconductive material.

In some embodiments, the coating has been applied in a spraying process, by means of which it is possible to achieve a particularly homogeneous layer thickness.

There follows a detailed elucidation of the production of an illustrative formulation for production of a coating in one embodiment in the form of a tabular summary:

Example

| Raw material | Mass |
|---|---|
| Resin component, for example an acrylate or polyurethane or a polyurethane-acrylate mixture | 530 |
| Hard component, for example an isocyanate or polyisocyanate | 162 |
| Coated mica | 300 |
| Conductive particulate filler, for example graphite | 300 |
| Dispersing additive + 30% (filler) | 180 |
| Total mass (dry): | 1180 |

The example shown specifies a formulation for a paint coating of a dry transformer in compact design, wherein the combination of environmentally compatible paint technology by virtue of water-based hardener components and the robustness nevertheless achieved from a mechanical and thermal point of view, as demonstrated in FIG. 1, demonstrates the technical innovation of the formulation shown here, especially in the case of use for dry transformers.

Figure 2:
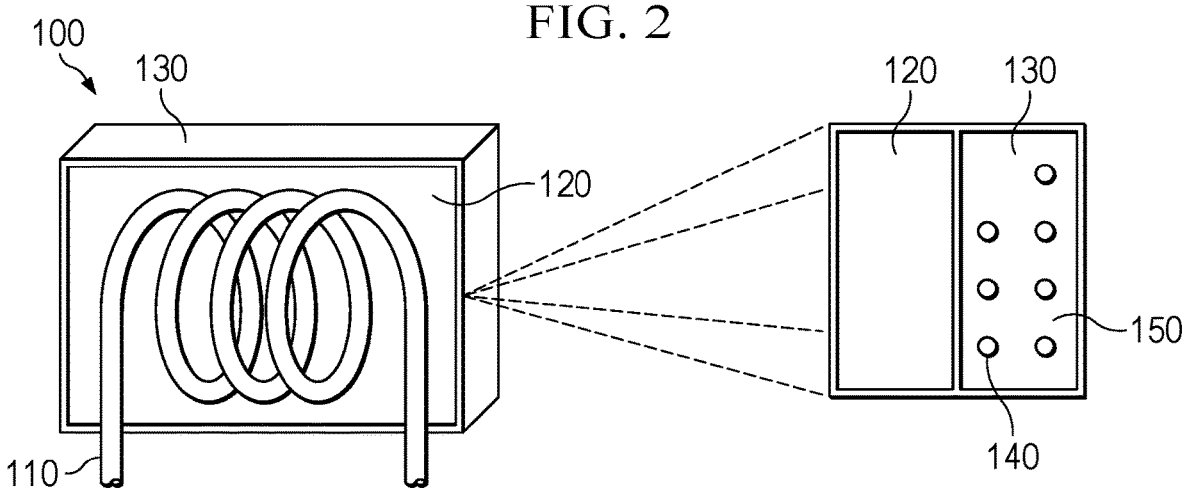
FIG. 2 is a schematic drawing showing an electrical winding incorporating teachings of the present disclosure.

FIG. 2 shows an electrical winding 100 for a dry transformer incorporating teachings of the present disclosure. As shown, the electrical winding 100 comprises a winding conductor 110 wound in multiple windings to form a coil. The coil is embedded in a solid insulation body 120. There is a coating 130 with a particular sheet resistance on a surface of the insulation body 120. The coating 130 comprises a resin component 150 and a microscale and electrically conductive filler 140 present in a particle size in the range from 1 μm to 2 mm.

What is claimed is:

1. An electrical winding for a dry transformer, the electrical winding comprising:

a winding conductor wound in multiple windings to form a coil;

the coil embedded in a solid insulation body;

a coating with a particular sheet resistance on a surface of the insulation body;

wherein the coating comprises a resin component and a microscale and electrically conductive filler present in a particle size in the range from 1 μm to 2 mm;

wherein a sheet resistance of the coating is defined via setting a ratio of at least two filler particle fractions.

2. The electrical winding as claimed in claim 1, wherein filler is present in the coating in an amount of more than 20% by weight and/or more than 10% by volume.

3. The electrical winding as claimed in claim 1, wherein the coating completely covers the surface of the insulation body.

4. The electrical winding as claimed in claim 1, wherein the coating comprises semiconductive material.

5. The electrical winding as claimed in claim 1, wherein the coating has includes at least two filler particle fractions.

6. The electrical winding as claimed in claim 1, wherein the surface resistance of the coating is 102Ω/□ to 105Ω/□.

7. The electrical winding as claimed in claim 1, wherein the coating comprises water as solvent.

8. The electrical winding as claimed in claim 1, wherein the coating is grounded.

9. An electrical winding for a dry transformer, the electrical winding comprising:

a winding conductor wound in multiple windings to form a coil;

the coil embedded in a solid insulation body;

a coating with a particular sheet resistance on a surface of the insulation body;

wherein the coating comprises a resin component and a microscale and electrically conductive filler present in a particle size in the range from 1 μm to 2 mm;

wherein a sheet resistance of the coating is defined via setting a ratio of coated to uncoated filler particles.

10. The electrical winding as claimed in claim 9, wherein filler is present in the coating in an amount of more than 20% by weight and/or more than 10% by volume.

11. The electrical winding as claimed in claim 9, wherein the coating completely covers the surface of the insulation body.

12. The electrical winding as claimed in claim 9, wherein the coating comprises semiconductive material.

13. The electrical winding as claimed in claim 9, wherein the coating has includes at least two filler particle fractions.

14. The electrical winding as claimed in claim 9, wherein the surface resistance of the coating is 102Ω/□ to 105Ω/□.

15. The electrical winding as claimed in claim 9, wherein the coating comprises water as solvent.

16. The electrical winding as claimed in claim 9, wherein the coating is grounded.

* * * * *